US006491010B2

(12) United States Patent
Kawamoto et al.

(10) Patent No.: US 6,491,010 B2
(45) Date of Patent: Dec. 10, 2002

(54) OVER-HEAD CAM TYPE V-TYPE ENGINE

(75) Inventors: Yuichi Kawamoto, Akashi (JP); Kiyohito Takano, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 10/093,209

(22) Filed: Mar. 7, 2002

(65) Prior Publication Data

US 2002/0129782 A1 Sep. 19, 2002

(30) Foreign Application Priority Data

Mar. 9, 2001 (JP) ..... 2001-066738

(51) Int. Cl.[7] ..... F01M 1/06; F01M 9/10

(52) U.S. Cl. ..... 123/90.27; 123/90.31; 123/90.34; 123/196 R; 123/196 M; 123/54.4; 184/6.9

(58) Field of Search ..... 123/90.27, 90.31, 123/90.33, 90.34, 196 R, 196 M, 54.4–54.8; 184/6.5, 6.9

(56) References Cited

U.S. PATENT DOCUMENTS 4,729,349 A * 3/1988 Sonoda et al. ..... 123/90.34
4,915,066 A * 4/1990 Koshimoto et al. ..... 123/90.27
5,010,859 A * 4/1991 Ogami et al. ..... 123/195 C
5,014,655 A * 5/1991 Ampferer ..... 123/90.31
5,857,441 A * 1/1999 Yonezawa et al. ..... 123/196 R
6,374,789 B2 * 4/2002 Kawamoto ..... 123/90.31

* cited by examiner

*Primary Examiner*—Weilun Lo
(74) *Attorney, Agent, or Firm*—Marshall, Gerstein & Borun

(57) ABSTRACT

An over-head cam type V-type engine comprises a crank shaft provided to penetrate through a crank chamber, a cam shaft provided in a head portion of each of two cylinders provided above the crank chamber, an intermediate shaft provided to penetrate through the crank chamber, a chain chamber for accommodating a chain to transmit a rotation of the crank shaft to the intermediate shaft, a first chain tunnel for accommodating a chain to transmit a rotation of the intermediate shaft to the cam shaft of one of the first and second cylinders, a second chain tunnel for accommodating a chain to transmit the rotation of the intermediate shaft to the cam shaft of the other cylinder, forcible oil supply means for supplying a lubricating oil from an oil sump to the head portion of each of the first and second cylinders, a first lubricating oil feedback path formed to reach the oil sump from the head portion of one of the first and second cylinders through the first chain tunnel and the crank chamber, and a second lubricating oil feedback path formed to reach the oil sump from the head portion of the other cylinder through the second chain tunnel and the chain chamber.

6 Claims, 7 Drawing Sheets

OVER-HEAD CAM TYPE V-TYPE ENGINE

BACKGROUND OF THE INVENTION

1. Field of the Invention

The present invention relates to an over-head cam type V-type engine, and more particularly to a V-twin engine comprising a lubricating oil feedback path from the head portion of a cylinder to an oil sump.

2. Description of the Related Art

FIG. 7 is a sectional view showing the structure of a conventional over-head cam type engine for an all terrain vehicle.

As shown in FIG. 7, the engine has a crank case 101 and a crank chamber 101*a* is formed in the crank case 101. A cylinder 102 is provided to extend upward from the upper end of the crank case 101 such that an inner portion thereof communicates with the crank chamber 101*a*. Moreover, a crank shaft 103 is provided to penetrate through the crank chamber 101*a* in a horizontal direction and a piston 104 which reciprocates in the cylinder 102 is coupled through a connecting rod to a portion of the crank shaft 103 which is accommodated in the crank chamber 101*a*. On the other hand, a head portion 102*a* of the cylinder 102 is provided with a cam shaft 105 for driving an intake valve and an exhaust valve (not shown) through a cam (not shown). A cam chain 108 for transmitting the rotation of the crank shaft 103 to the cam shaft 105 and rotating the cam shaft 105 is co-wound on sprockets 107 and 106 provided on one end of the cam shaft 105 and a portion 103*a* of the crank shaft 103 which protrudes toward the outside of the crank chamber 101*a*, respectively. The cam chain 108 is accommodated in a cam chain tunnel 109 formed in the side portion of the cylinder 102 and a chain chamber 101*b* formed in the side portion of the crank case 101 to be connected to the cam chain tunnel 109 and separated from the crank chamber 101*a* through a wall. An oil chamber (not shown) is formed in the crank case 101 to communicate with the lower ends of the chain chamber 101*b* and the crank chamber 101*a*. An oil pump and an oil passage (not shown) are provided to supply a lubricating oil accumulated in the oil chamber to the cam shaft 105 provided in the head portion 102*a* of the cylinder 102 and the like. The reference numeral 110 denotes a belt converter provided on an end of the crank shaft 103 which penetrates through the chain chamber 101*b* and extends toward the outside thereof. The belt converter 110 serves to cause a driver to easily carry out a speed change operation of a vehicle.

In the over-head cam engine having such a structure, the cam shaft 105 or the like is lubricated by the lubricating oil supplied to the head portion 102*a* of the cylinder 102 and the lubricating oil which completes the lubrication is returned to the oil chamber through the chain tunnel 109 and the chain chamber 101*b*. Consequently, the cam shaft 105 or the like is forcibly lubricated.

If the cam shaft structure of the conventional over-head cam engine is to be applied to a engine having two cylinders inclined in opposite directions to each other, it is necessary to provide two sprockets for driving the cam shafts of the two cylinders on the crank shaft. Correspondingly, the length of the crank shaft is increased so that the width of the engine is made greater. There is a cam shaft driving structure in which the cam shafts of the two cylinders are driven through an intermediate shaft by a crank shaft. In such a cam shaft driving structure, the intermediate shaft is provided above the crank shaft to penetrate through the crank chamber and a sprocket for driving the cam shaft of each cylinder is provided in each of portions of the intermediate shaft which protrude toward outsides of the crank chamber, respectively, and only one sprocket for driving the intermediate shaft is provided on the crank shaft. As a result, one sprocket on the crank shaft is omitted, so that the width of the engine can be reduced.

In the cam shaft driving structure, however, if an oil passage extending from the chain chamber to the oil chamber is provided as in the conventional over-head cam type engine, the oil passage is to be formed in both side portions of the crank chamber. For this reason, the size of a crank case is increased, and furthermore, the size of an engine is increased. Moreover, a space in the crank case cannot be utilized effectively.

SUMMARY OF THE INVENTION

In order to solve the above-mentioned problems, it is an object of the present invention to provide an over-head cam type V-type engine which can be small-sized and can efficiently utilize a space in a crank case.

In order to attain the object, the present invention provides an over-head cam type V-type engine comprising a crank case having a crank chamber, a crank shaft provided to penetrate through the crank chamber, a first cylinder and a second cylinder provided in an upper portion of the crank chamber to be positioned on virtual lines extending like a V-shape upward from a center of the crank shaft as seen in an axial direction of the crank shaft, respectively, a cam shaft provided in a head portion of each of the first and second cylinders, an intermediate shaft provided above the crank shaft to penetrate through the crank chamber, a first transmitting means for transmitting a rotation of the crank shaft to the intermediate shaft through a chain at one of end sides of the intermediate shaft, a chain chamber formed adjacently to a side portion of the crank chamber and serving to accommodate the first transmitting means, a second transmitting means for transmitting a rotation of the intermediate shaft to the cam shaft of one of the first and second cylinders through a chain at the other end side of the intermediate shaft, a first chain tunnel for accommodating the second transmitting means, a third transmitting means for transmitting the rotation of the intermediate shaft to the cam shaft of the other cylinder through a chain at one of the end sides of the intermediate shaft, a second chain tunnel for accommodating the third transmitting means, an oil sump formed in a lower portion of the crank case and serving to accumulate a lubricating oil therein, a forcible oil supply means for supplying the lubricating oil from the oil sump to the head portion of each of the first and second cylinders such that each cam shaft is lubricated, a first lubricating oil feedback path formed such that the lubricating oil supplied to the head portion of one of the first and second cylinders flows down into the oil sump through the first chain tunnel and the crank chamber, and a second lubricating oil feedback path formed such that the lubricating oil supplied to the head portion of the other cylinder flows down into the oil sump through the second chain tunnel and the chain chamber.

In this specification, "above" also implies an obliquely upward direction as well as a just upward direction.

According to such a structure, the lubricating oil feedback path utilizes the inner space of the crank chamber, so that a space in the crank case can be saved. Consequently, the space of the crank case can be utilized efficiently. Moreover, the size of the engine can be reduced.

The cylinder may have a skirt portion, the skirt portion being provided to be inserted into the crank chamber, and an inlet hole for the lubricating oil flowing from the first chain tunnel into the crank chamber may be opened in a portion of an internal surface of the crank chamber which is opposed to a peripheral surface of the skirt portion of the cylinder.

According to such a structure, even if the lubricating oil vigorously flows into the crank chamber through the inlet hole, it hits against the skirt portion of the cylinder and is thereby prevented from advancing toward the inside of the crank chamber. Consequently, it is possible to prevent the lubricating oil from splashing on the crank shaft positioned in the crank chamber and its temperature from being raised.

A lubricating oil guide member may be provided on the internal surface of the crank chamber to guide the lubricating oil flowing into the crank chamber from the first chain tunnel through the inlet hole for the lubricating oil toward the oil sump avoiding a rotation region of the crank shaft accommodated in the crank chamber.

According to such a structure, the lubricating oil flowing from the inlet hole can be guided toward the oil sump so as not to splash on a crank web or a crank pin. As a result, it is possible to more effectively prevent the temperature of the lubricating oil from being raised.

The lubricating oil member may extend between an inner side surface of the crank chamber and an outer surface of the skirt portion of the cylinder circumferentially outside of rotation region of crank shaft from lower end of the inlet hole.

The first chain tunnel may be formed to extend from the head portion of one of the first and second cylinders and terminated in a portion of the crank case which includes the other end of the intermediate shaft, a belt converter for transmitting a power of the V-type engine to a transmission may be provided adjacently to the crank chamber in a portion of the crank shaft which protrudes from the crank chamber toward the other end side of the intermediate shaft, and an ambient air intake passage for cooling the belt converter may be formed adjacently to a terminating portion of the first chain tunnel.

According to such a structure, the size of the ambient air intake passage for cooling the belt converter can be reduced by effectively utilizing a space in the crank case. Furthermore, the amount of the protrusion of the belt converter toward the side can be decreased. Consequently, the width of the engine can be reduced.

The ambient air intake passage may be provided under the first chain tunnel and around a support boss which has a bearing supporting the crank shaft therein and protrudes from a side wall of the crank chamber.

These objects as well as other objects, features and advantages of the present invention will become more apparent to those skilled in the art from the following description with reference to the accompanying drawings.

DETAILED DESCRIPTION OF THE PREFERRED EMBODIMENTS

A preferred embodiment of the present invention will be described below with reference to the drawings.

Figure 1:
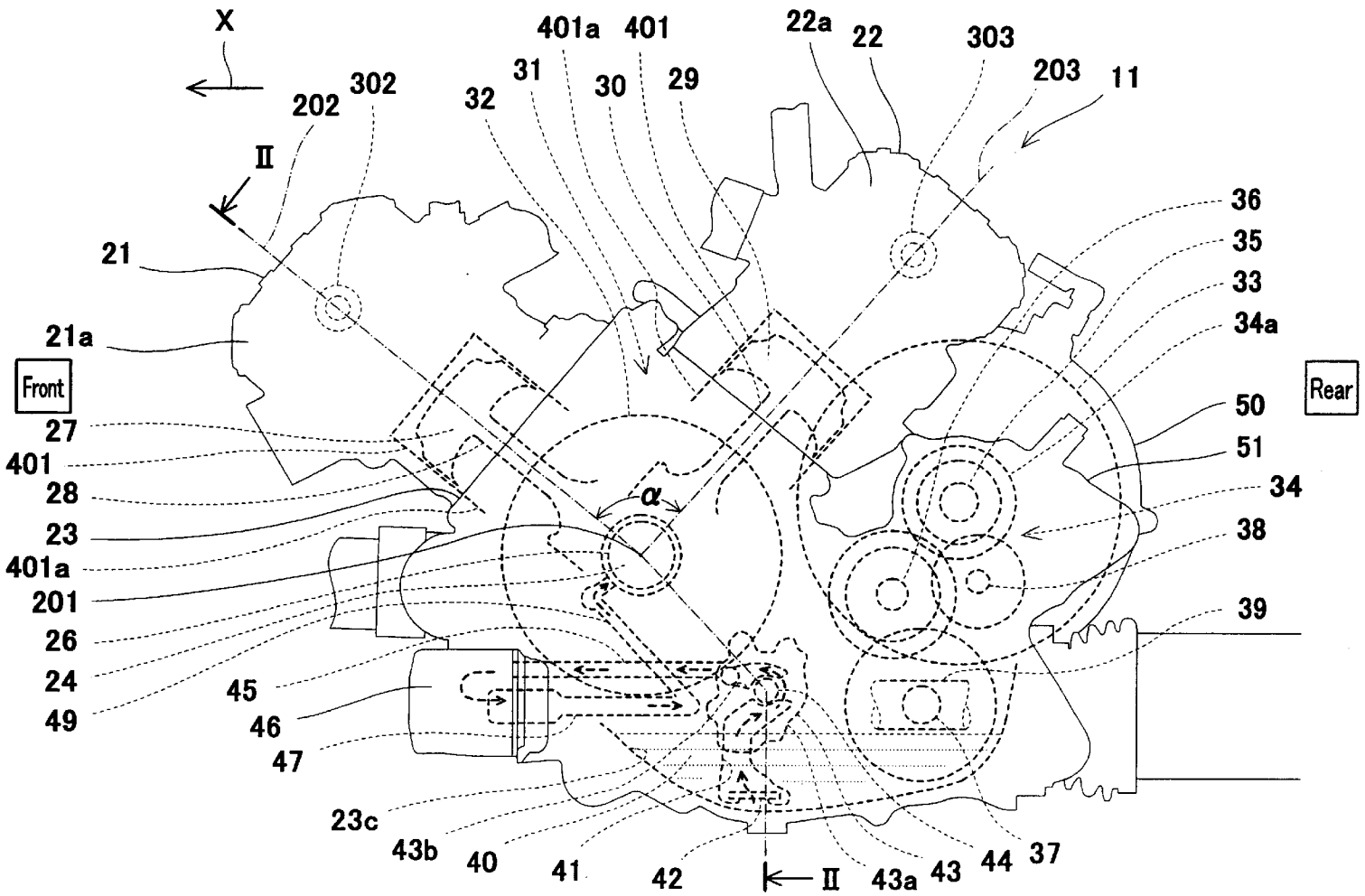
FIG. 1 is a left side view typically showing the structure of an over-head cam type V-twin engine according to an embodiment of the present invention.
Figure 2:
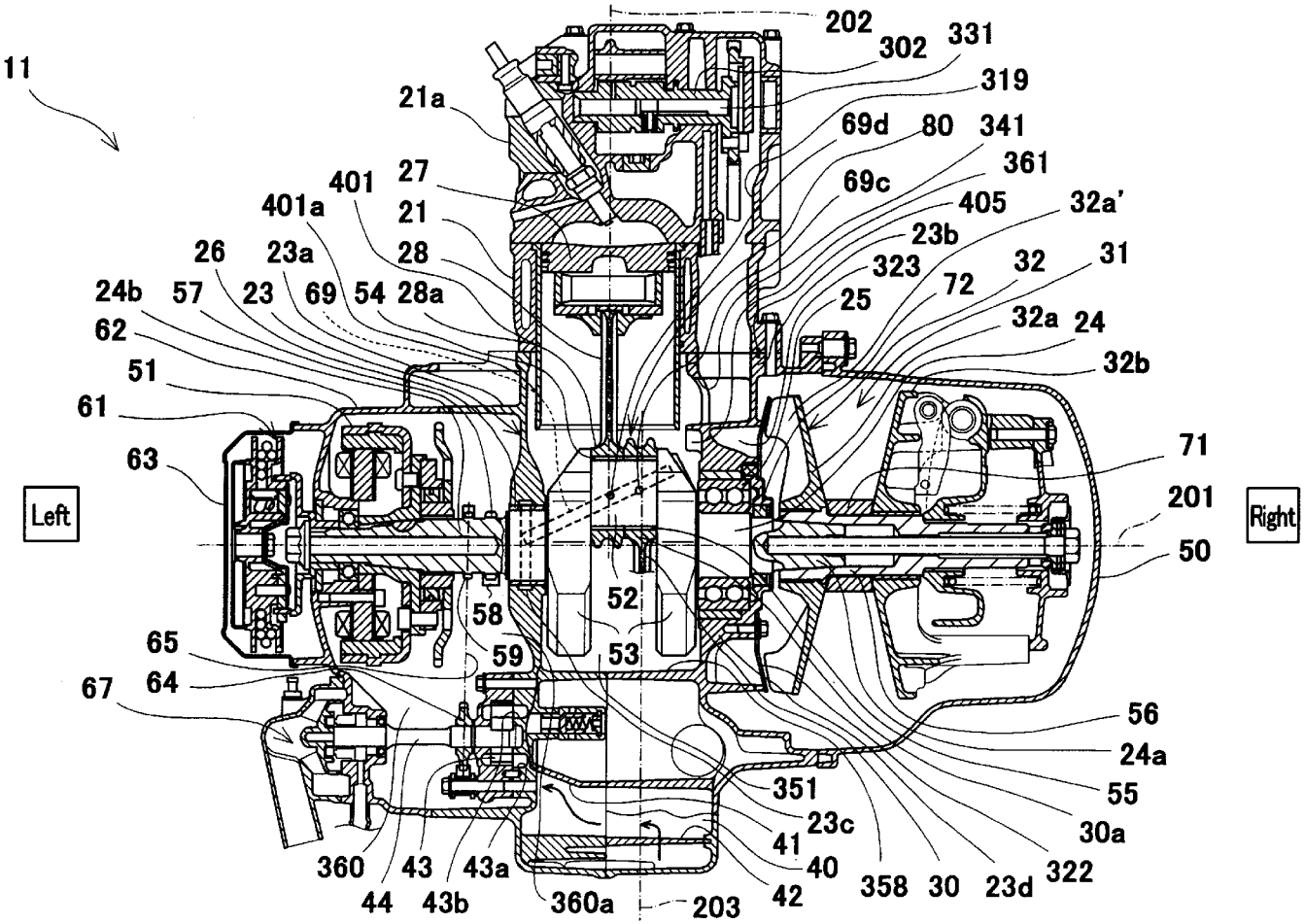
FIG. 2 is a sectional view taken along a line II—II in FIG. 1.
Figure 3:
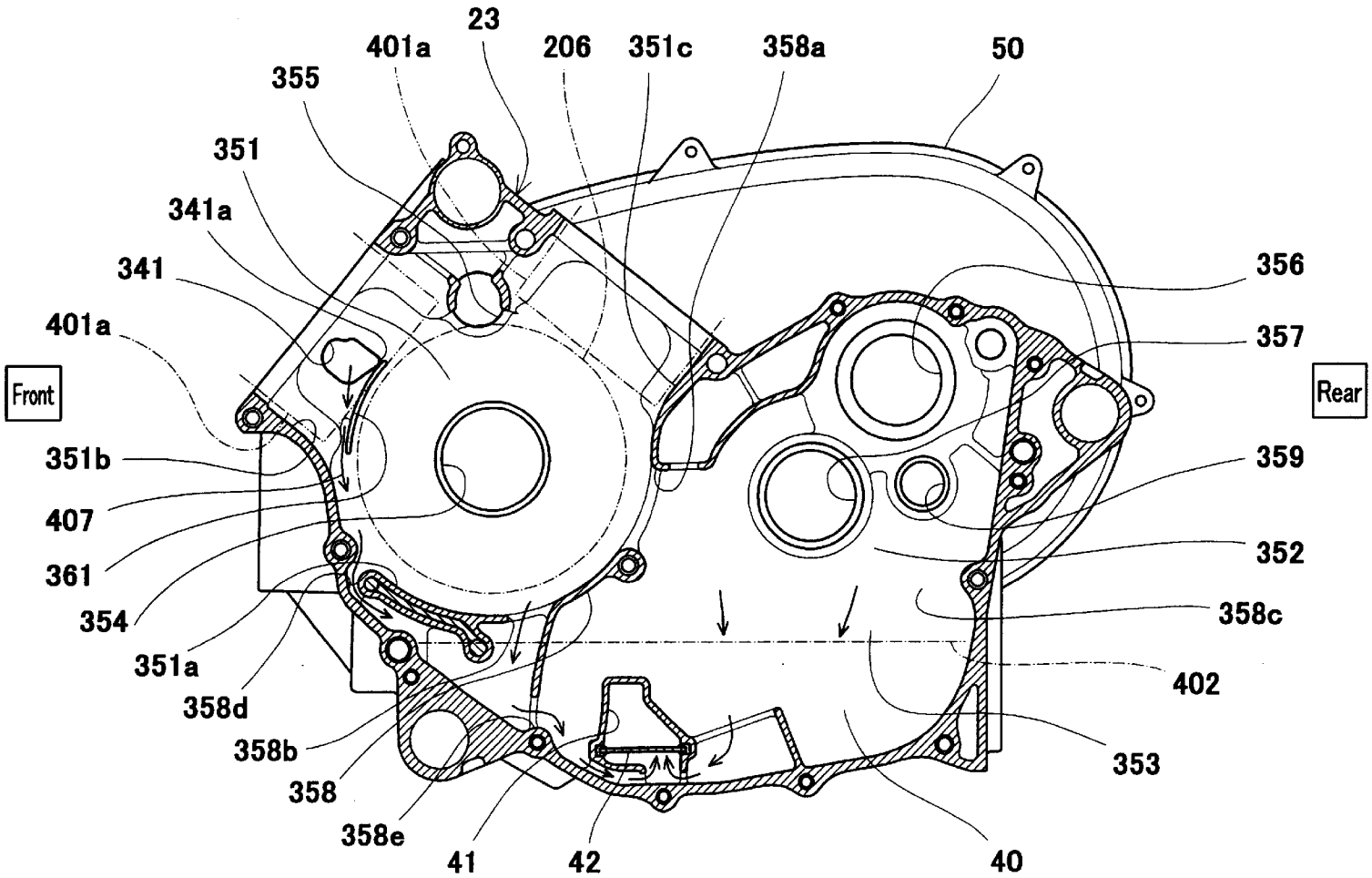
FIG. 3 is a view showing a right crank case as seen from leftward.
Figure 4:
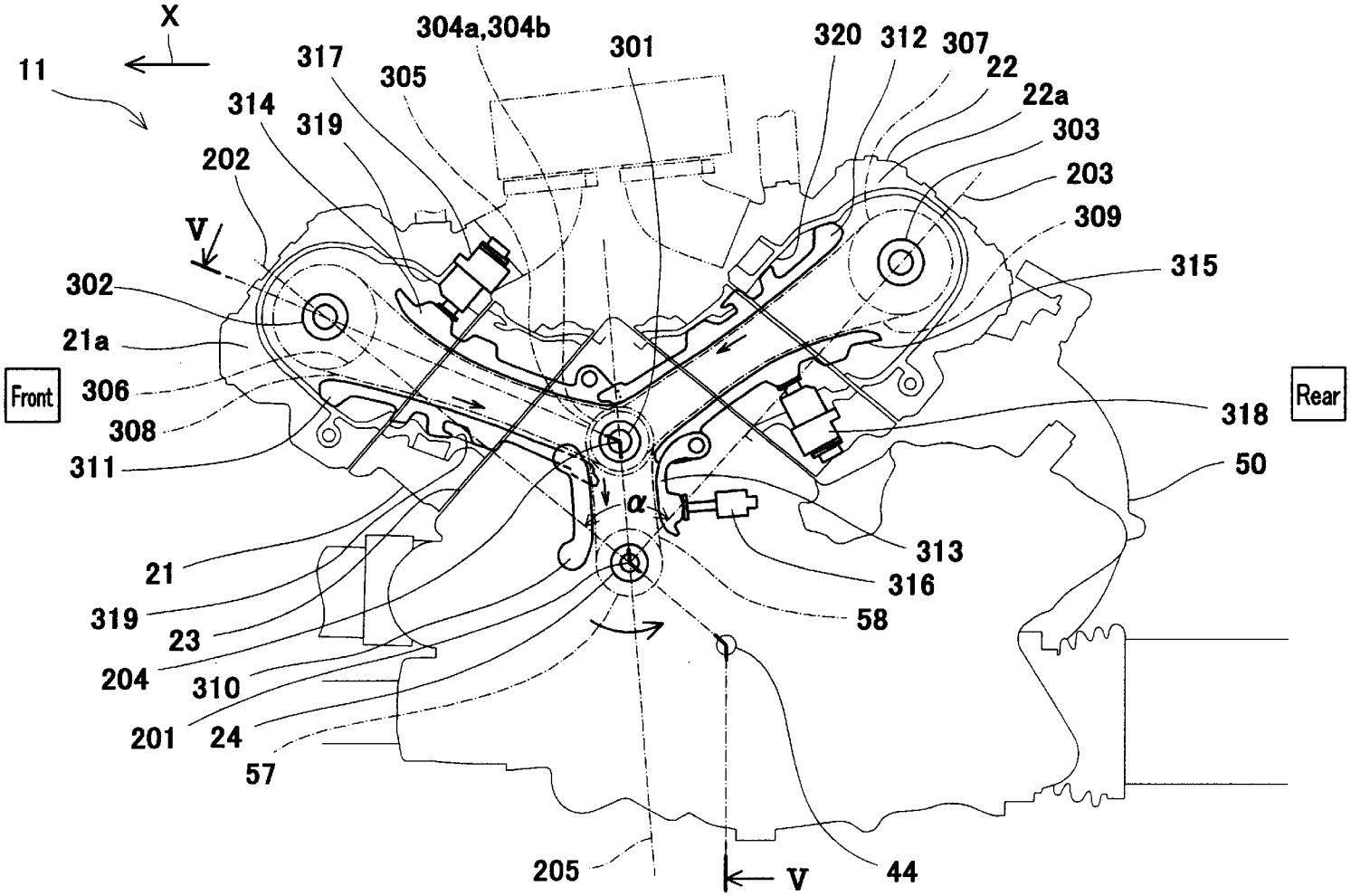
FIG. 4 is a left side view showing a mechanism for transmitting a rotation from a crank shaft to a cam shaft in the V-twin engine of FIG. 1.
Figure 5:
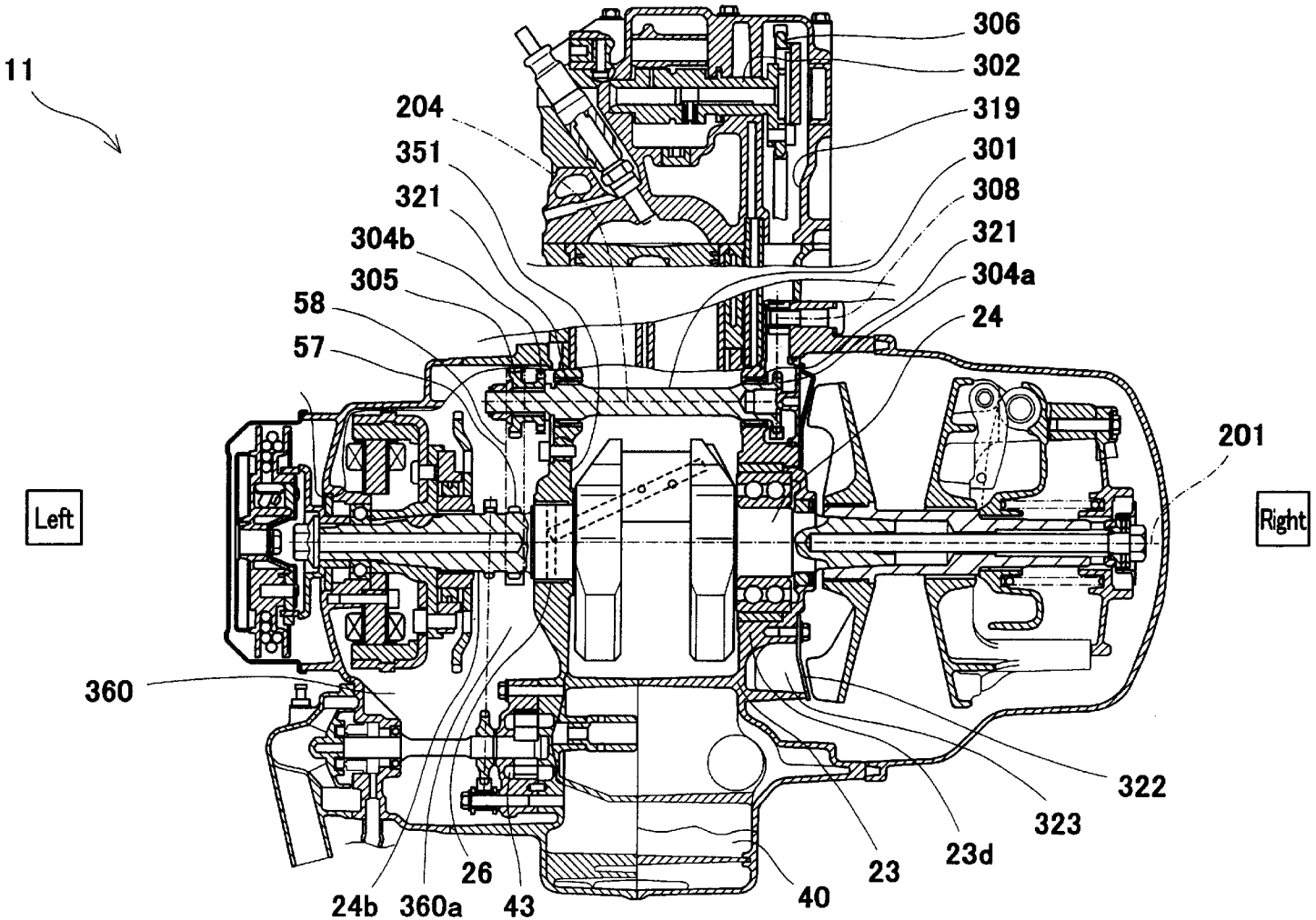
FIG. 5 is a sectional view taken along a line V—V in FIG. 4.
Figure 6:
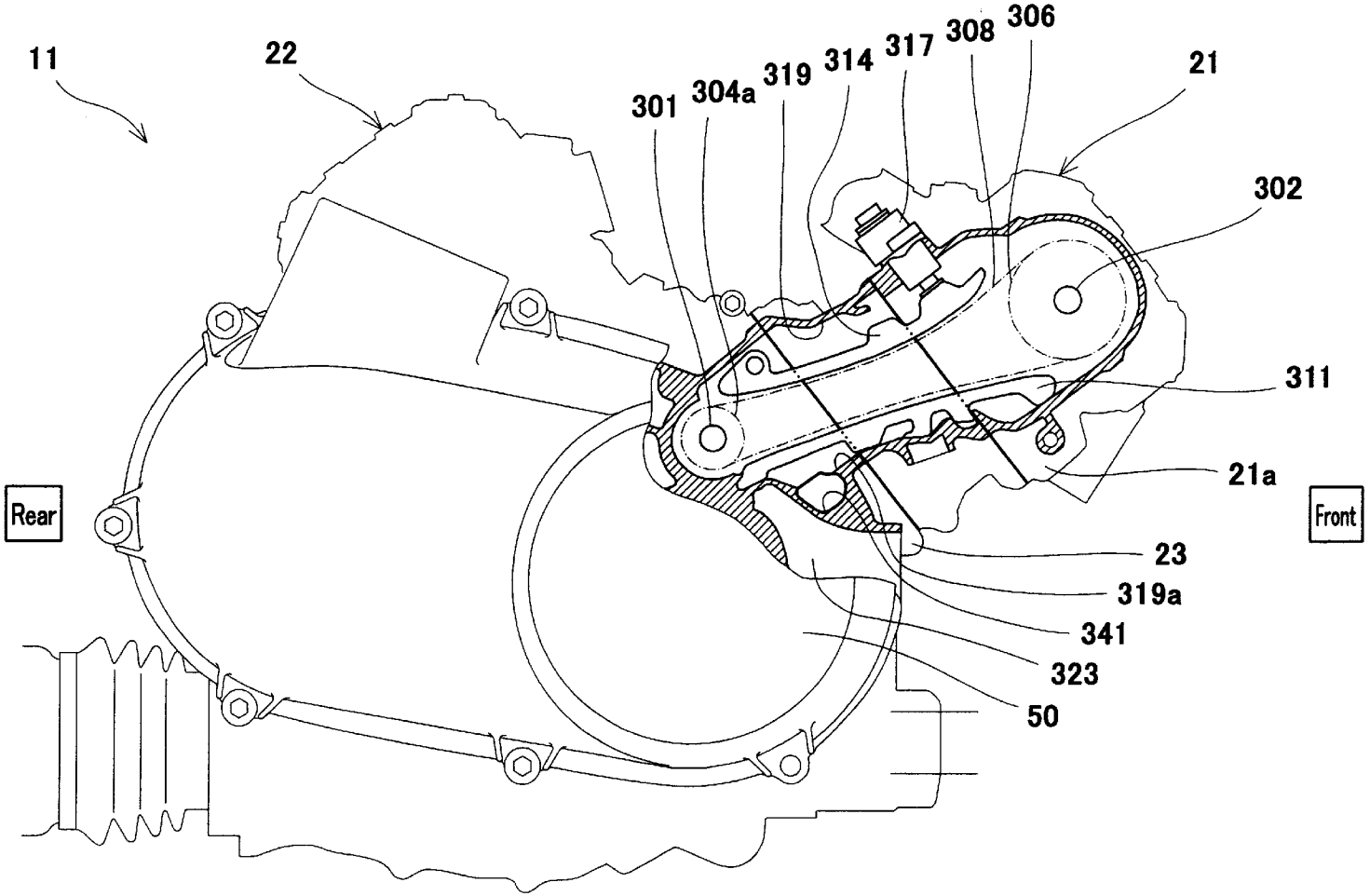
FIG. 6 is a right side view showing the structure of a chain tunnel of a forward cylinder, a part of which is taken away.
Figure 7:
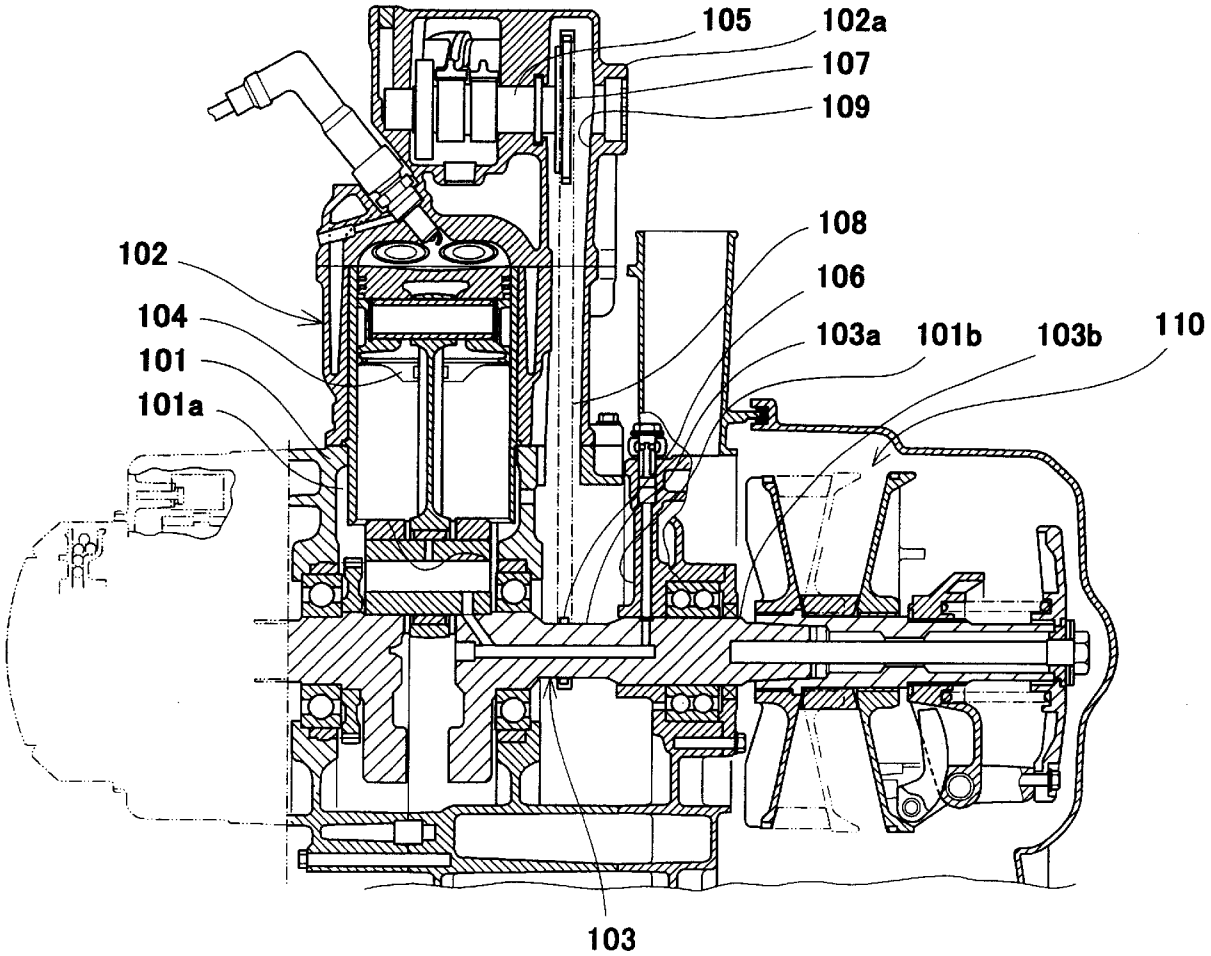
Fig. 7 PRIOR ART
FIG. 7 is a sectional view showing the structure of a conventional over-head cam type V-twin engine.

FIG. 1 is a left side view typically showing the structure of an over-head cam type V-twin engine according to an embodiment of the present invention. FIG. 2 is a sectional view taken along a line II—II in FIG. 1. FIG. 3 is a view showing a right crank case as seen from leftward. FIG. 4 is a left side view showing a mechanism for transmitting a rotation from a crank shaft to a cam shaft in the V-twin engine of FIG. 1. FIG. 5 is a sectional view taken along a line V—V in FIG. 4. FIG. 6 is a right side view showing the structure of a chain tunnel of a forward cylinder, a part of which is taken away. FIGS. 1 and 4 are perspective views for easily understanding the description. Moreover, FIG. 4 shows a section of a chain tunnel which is cut in a plane where a cam chain extends. For easily understanding the description, furthermore, FIG. 3 shows a state in which parts in a crank case are removed.

In the present embodiment, an over-head cam type V-twin engine (hereinafter referred to as a V-twin engine) is provided with a belt converter. The V-twin engine is mounted on a four-wheel straddle-type all terrain vehicle and a crank shaft is directed in the lateral direction of the vehicle in the present embodiment. Arrows X in FIGS. 1 and 4 indicate the forward direction of the four-wheel straddle-type all terrain vehicle.

First of all, the schematic structure of a V-twin engine 11 will be described.

As shown in FIG. 1, a crank shaft 24 is provided to penetrate through a crank case 23 in a lateral direction (see FIG. 2) and a forward cylinder 21 and a rearward cylinder 22 are inclined forwardly and backwardly above the front part of the crank case 23 respectively in the V-twin engine 11. The forward cylinder 21 and the rearward cylinder 22 are provided such that center lines 202 and 203 of cylinder liners 401 extend to have a V-shape upward from a shaft axis 201 of the crank shaft 24 as seen from a side. A crossing angle formed by the center lines 202 and 203 of the cylinder liners of the forward cylinder 21 and the rearward cylinder 22 seen from a side, that is, an angle a formed by the forward cylinder 21 and the rearward cylinder 22 is 90 degrees in the present embodiment. The reason is that the oscillation of the V-twin engine 11 should be reduced as much as possible.

A connecting rod 28 of a piston 27 of the forward cylinder 21 and a connecting rod 30 of a piston 29 of the rearward cylinder 22 are coupled to the crank shaft 24, respectively. An input shaft 35 of a transmission is provided behind the crank shaft 24 in parallel with the crank shaft 24, and a belt converter 31 is provided between the input shaft 35 of the transmission and the crank shaft 24. More specifically, a drive pulley 32 is provided on one of the ends of the crank shaft 24 and a driven pulley 33 is provided on the input shaft 35 of the transmission, and a belt (not shown) is co-wound on the pulleys 32 and 33. An output shaft 39 is provided to extend in a longitudinal direction below the input shaft 35 of the transmission, and the output shaft 39 and the input shaft 35 of the transmission are connected to each other through a transmission 34. In other words, an intermediate shaft 36 for speed change, an idle shaft 38 for reverse and a bevel gear shaft 37 are provided below the input shaft 35 of the transmission in parallel with the crank shaft 24, respectively. The four shafts including the input shaft 35 are mutually coupled such that a transmission ratio and a rotating direction can be changed by a gear group 34*a* provided therein.

On the other hand, the forward cylinder 21 and the rearward cylinder 22 are provided with cam shafts 302 and 303 for driving an intake valve and an exhaust valve (not shown), respectively. Moreover, the internal spaces of the cylinder liners 401 in which the pistons 27 and 29 of the forward cylinder 21 and the rearward cylinder 22 reciprocate communicate with the internal space of the crank case 23, and coupling portions of the connecting rods 28 and 30 and the crank shaft 24 are accommodated in the crank case 23. Moreover, the transmission 34 is also accommodated in the crank case 23. An oil sump 40 is formed in a bottom portion 23*c* of the crank case 23 and an oil pump 43 is provided on the left side surface of the crank case 23 (see FIG. 2). An oil path 41 is provided such that an inlet is positioned in the oil sump 40 and an outlet communicates with an intake port 43*a* of the oil pump 43. A primary filter 42 is provided in the inlet portion of the oil passage 41. A first oil path 45 is connected to an exhaust port 43*b* of the oil pump 43, a secondary filter 46 is connected to the first oil passage 45, and a main gallery 47 is connected to the secondary filter 46. A second oil path 49 is formed from the main gallery 47 to a second bearing 26 for supporting the left end of the crank shaft 24. As will be described later, furthermore, a third oil path 69 (see FIG. 2) is formed from the second bearing 26 to the coupling portions of the connecting rods 28 and 30 and the crank shaft 24. Moreover, an oil path (not shown) is formed from the main gallery 47 to the cam shafts 302 and 303 in head portions 21*a* and 22*a* of the forward cylinder 21 and the rearward cylinder 22. Consequently, a lubricating oil in the oil sump 40 is sucked from the inlet of the oil passage 41 into the oil pump 43 and is discharged from the discharge port 43*b* of the oil pump 43, and is supplied to each place to be lubricated through the secondary filter 46. The oil passage 41, the oil pump 43, the filters 42 and 46 and the oil path to each place constitute forcible oil supply means.

The lubricating oil supplied to the head portions 21*a* and 22*a* of the forward cylinder 21 and the rearward cylinder 22 is fed back to the oil sump 40 through chain tunnels 319 and 320 (see FIG. 4) and the crank case 23 as will be described below in detail. Moreover, the lubricating oil supplied to other places is dropped into the crank case 23 and is accumulated in the oil sump 40. As described above, the forcible circulating structure of the lubricating oil is constructed.

Next, the structure of each portion will be described.

As shown in FIG. 2, the crank case 23 is divided into left and right crank cases 23*a*, 23*b*, which are joined to be formed into one crank case 23.

As shown in FIGS. 3 and 1, a crank chamber 351 for accommodating the crank shaft 24, and a transmission chamber 352 for accommodating the transmission 34 and an oil chamber 353 for forming the oil sump 40 are divided by a partition wall 358 in the crank case 23. The crank chamber 351, the transmission chamber 352 and the oil chamber 353 are formed in the front part of an upper portion, the rear part of the upper portion, and a lower portion in the crank case 23 respectively and communicate with each other through communicating portions 358*a*, 358*b*, 358*c* and 358*d* provided in the partition wall 358. The reference numerals 354, 356, 357 and 359 denote through holes of the crank shaft 24, the input shaft 35, the intermediate shaft 36 for speed change and the idle shaft 38 for reverse (accurately, bearing fitting holes thereof), respectively. Thus, the crank case and the transmission case are integrated in the V-twin engine 11. The reference numeral 355 denotes a through hole for supporting an intermediate shaft 301 (see FIG. 4) of a mechanism for transmitting a rotation to the cam shaft which will be described later.

The transmission 34 is accommodated in the transmission chamber 352 in such a manner that the input shaft, the intermediate shaft for speed change and the idle shaft for reverse are fitted in the through holes 356, 357 and 359 together with bearings, respectively.

As shown in FIGS. 2 and 3, the oil passage 41 is formed in bottom portion of the oil chamber 353 and has an inlet provided with the primary filter 42 and an output communicating with the intake port 43*a* of the oil pump 43. Moreover, the oil sump 40 is formed in the oil chamber 353. An oil level 402 of the oil sump 40 is set such that the accumulated lubricating oil does not splash on the crank shaft 24 (a crank web 53 or the like) in the crank chamber 351 even if a vehicle body is inclined so that the V-twin engine 11 is tilted.

As shown in FIGS. 1 and 2, the crank shaft 24 is provided to penetrate through the crank chamber 351 of the crank case 23 in a lateral direction. A first bearing 25 and a second bearing 26 are provided in portions of the right and left side walls of the crank case 23 through which the crank shaft 24 penetrate, respectively. The crank shaft 24 is rotatably held in the crank case 23 by means of the first bearing 25 and the second bearing 26. The first bearing 25 is constituted by a double row ball bearing and the second bearing 26 is constituted by a plain bearing.

The crank web 53, the crank pin 52, large ends 23*a* and 30*a* of the connecting rods and the like are accommodated in the crank chamber 351, and the large end 28*a* of the connecting rod 28 of the piston in the forward cylinder 21 and the large end 30*a* of the connecting rod 30 of the piston 29 in the rearward cylinder 22 are coupled to the crank pin 52 through bearings 54 and 55, respectively.

The belt converter 31 is provided on a right end 24*a* of the crank shaft 24. In detail, the belt converter 31 is separated (sealed) from the inside of the crank case 23 through the right side wall of the crank chamber 351. A main shaft 56 of the belt converter 31 is integrally connected to a portion of the crank shaft 24 which protrudes rightwards from the first bearing 25, and the drive pulley 32 is provided on the main shaft 56. A belt 71 is co-wounded on the drive pulley 32 and the driven pulley 33. The belt converter 31 is covered with a belt converter cover 50 provided on the right side surface of the crank case 23.

The drive pulley 32 has a fixed sheave 32*a* fixed to the main shaft 56 adjacently to the crank case 23 and a movable sheave 32*b* positioned on the outside (right) of the fixed sheave 32*a*. The movable sheave 32*a* is attached to the main shaft 56 integrally rotatably and movably in an axial direction thereof. A rear surface 32*a*' of the fixed sheave 32*a* has such a shape as to form a fan. On the other hand, a space 323 is formed to surround a support boss 23*d* which is provided in right side wall of crank chamber 351 to protrude outward and holds the first bearing 25 therein. An outside (right) of the space 323 is partitioned by a plate 322 so that an ambient air intake passage 323 to the fan is formed. Consequently, an ambient air (an air which exists outside of V-twin engine 11) is sucked from the ambient air intake passage 323 through the fan, so that the belt converter 31 is cooled. Moreover, a seal 72 for preventing the lubricating oil from entering the belt converter 31 is provided on the support boss 23*d* adjacent to and outside the first bearing 25 of the crank case 23 through which the crank shaft 24 penetrates.

On the other hand, a first sprocket 57, a sprocket 59 for a pump drive shaft, a generator 51 and a recoil starter 61 are attached to a left end portion 24*b* of the crank shaft 24 in order from the inside. As will be described below, the first sprocket 57 serves to drive the cam shafts 302 and 303 of the forward cylinder 21 and the rearward cylinder 22 through an intermediate shaft chain 58 and an intermediate shaft 301 (see FIG. 4) and the like.

The oil pump 43 is provided in a lower portion of the left side surface of the crank case 23 and is driven by a pump drive shaft 44. The exhaust port 43*b* of the oil pump 43 communicates with the first oil path 45 (see FIG. 1). A sprocket 64 is provided on the pump drive shaft 44 and a chain 65 is co-wound on the sprocket 64 and the sprocket 59 for a pump drive shaft of the crank shaft 24. Consequently, the pump drive shaft 44 is driven by the crank shaft 24. The reference numeral 67 denotes a water pump which is coaxially attached to the pump drive shaft 44. Moreover, the reference numeral 62 denotes a generator cover provided on the left side surface of the crank case 23 and serving to cover the sprocket 57 for an intermediate shaft, the sprocket 59 for a pump drive shaft, the generator 51 and the oil pump 43, and the reference numeral 63 denotes a recoil starter cover provided integrally with the generator cover 62 and serving to cover the recoil starter 61. A space covered with the generator cover 62 constitutes an auxiliary machinery room 360 including a chain chamber 360*a*.

As shown in FIG. 2, the second bearing 26 is provided in a portion (hereinafter referred to as the second bearing support portion) 23*c* of the left side wall of the crank case 23 through which the crank shaft 24 penetrates and the second oil path 49 (see FIG. 1) is opened in the second bearing support portion 23*c*. The third oil path 69 is formed from the second bearing support portion 23*c* to bearings 54 and 55 of a coupling portion 80 of the large ends of the connecting rods 28 and 30 in the forward cylinder and the rearward cylinder through the inside of the second bearing 26 and the inside of the crank shaft 24. Moreover, an oil path is formed from the second bearing support portion 23*c* to the head portions 21*a* and 22*a* of the forward cylinder 21 and the rearward cylinder 22 in order to forcibly supply an oil to the cam shaft provided in the head portion of each cylinder, which is not shown.

Next, detailed description will be given to a feedback path for the lubricating oil to be supplied to the head portions 21*a* and 22*a* of the forward cylinder 21 and the rearward cylinder 22.

First of all, description will be given to a mechanism for transmitting a rotation from the crank shaft to the cam shaft.

As shown in FIGS. 3, 4 and 5, the first sprocket 58 is provided in the portion 24*b* of the crank shaft 24 which protrudes leftwards from the crank chamber 351 adjacently to the second bearing 26. The intermediate shaft 301 is provided in upper portion of the crank chamber 351 to penetrate through the crank chamber 351. The intermediate shaft 301 is provided in parallel with the crank shaft 24 such that a shaft axis 204 is positioned above the crank shaft 24 and on a center plane 205 of the angle a formed by the forward cylinder 21 and the rearward cylinder 22, and is rotatably supported on a pair of bearings 321 fixed to both side walls of the crank chamber 351. A fifth sprocket 304*a* is provided in a portion of the intermediate shaft 301 which protrudes rightwards from the crank chamber 351. Moreover, a sixth sprocket 304*b* and a second sprocket 305 are provided integrally side by side in a portion of the intermediate shaft 301 which protrudes leftwards from the crank chamber 351. The fifth and sixth sprockets 304*a* and 304*b* are formed to have smaller outside diameters than the outside diameter of the second sprocket 305. The intermediate shaft chain 58 is co-wounded on the first sprocket 57 of the crank shaft 24 and the second sprocket 305 of the intermediate shaft 301. The first sprocket 57, the second sprocket 305 and the intermediate shaft chain 58 are accommodated in the chain chamber 306*a* (the auxiliary machinery room 360).

On the other hand, the forward cylinder cam shaft 302 is provided in the head portion 21*a* of the forward cylinder 21 and the rearward cylinder cam shaft 303 is provided in the head portion 22*a* of the rearward cylinder 22. The cam shafts 302 and 303 are provided in parallel with the crank shaft 24, respectively. As shown in FIGS. 4 to 6, a third sprocket 306 is provided on the forward cylinder cam shaft 302 and a fourth sprocket 307 is provided on the rearward cylinder cam shaft 303. The third sprocket 306 is provided on the right end of the forward cylinder cam shaft 302. The first chain tunnel 319 is formed to extend from a portion of the crank case 23, in which the fifth sprocket 304*a* is provided, to a portion of the head portion 21 in which the third sprocket 306 is provided, through the right side portion of the forward cylinder 21. The first cam chain 308 is co-wound on the fifth sprocket 304*a* of the intermediate shaft 301 and the third sprocket 306 of the forward cylinder cam shaft 302 through the first chain tunnel 319. As is apparent from FIGS. 5 and 6, the first chain tunnel 319 is formed such that the support boss 23*d* of the first bearing 25 and the ambient air intake passage 323 are positioned below a termination part thereof.

Moreover, the fourth sprocket 307 of the rearward cylinder 22 is provided on the left end of the rearward cylinder cam shaft 303 and a second chain tunnel 320 is formed to extend from a portion of the chain chamber 360*a* in which the sixth sprocket 304*b* is provided to a portion of the head portion 22*a* in which the fourth sprocket 307 is provided through the left side portion of the rearward cylinder 22, which is not shown. A second cam chain 309 is co-wound on the sixth sprocket 304*b* and the fourth sprocket 307 of the rearward cylinder cam shaft 30 through the second chain tunnel 320. Consequently, the rotation of the crank shaft 24 is transmitted to the forward cylinder cam shaft 302 and the rearward cylinder cam shaft 303 through the intermediate shaft 301, thereby the cam shafts 302 and 303 are rotated, so that the intake valve and the exhaust valve are opened or closed in the cylinders 21 and 22. The reference numerals 310 to 315 denote chain guides for guiding a chain and the reference numerals 316 to 318 denote tensioners for giving a tension to the chain.

Next, description will be given to the feedback path for the lubricating oil which utilizes the chain tunnel of the rotation transmitting mechanism having such a structure.

As shown in FIGS. 2 and 3, the crank chamber 351 is constituted by a body portion 351*a* for accommodating the crank web 53 and the crank pin 52 and first and second skirt accommodating portions 351*b* and 351*c* for accommodating skirt portions 401*a*, 401*a* being lower portions of the forward cylinder and the rearward cylinder. The body portion 351*a* has a size required for accommodating the crank web 53 and the crank pin 52 turning around the shaft axis 201 of the crank shaft 24, the large ends 28*a* and 30*a* of the connecting rods and the like. In order to reduce the size of the crank chamber 351 as much as possible in the present embodiment, the body portion 351*a* is generally formed cylindrically to have a slightly greater length (width) than the total width of the crank web 53 and the crank pin 52 and to have a slightly larger diameter than the diameters of the turning regions of the crank web 53 and the crank pin 52 (the rotation region of the crank shaft). FIG. 3 shows a trajectory (turning diameter) 206 of the crank web 52. The first and second skirt accommodating portions 351*b* and 351*c* having a short cylindrical shape are formed to extend forward and obliquely upward and rearward and obliquely upward from the upper surface of the body portion 351*a* and to be opened on the upper surface of the crank case 23, respectively. The forward cylinder 21 is attached to the crank case 23 such that the skirt portion 401*a* of the cylinder liner 401 is fitted into the first skirt accommodating portion 351*b* of the crank chamber 351. The skirt portion 401 a of the forward cylinder is provided such that a lower end thereof extends near the trajectory 206 of the crank web as seen from a side and has a clearance with respect to the internal surface of the first skirt accommodating portion 351*b* of the crank chamber 351. The forward cylinder 21 is positioned with respect to the crank case 23 by means of a knock pin 405. While the cylinder liner 401 is formed separately from the body of the forward cylinder 21 in the present embodiment, it may be formed integrally with the body of the forward cylinder 21. The above-mentioned respects are the same as in the rearward cylinder.

On the other hand, as shown in FIG. 6, the first chain tunnel 319 is formed to extend obliquely upward from the upper part of the crank case 23 toward the head portion 21*a* of the forward cylinder 21, and an oil hole (inlet hole) 341 is formed on the side wall of the crank chamber to be situate near the lower wall of the first chain tunnel 319 which is located in the crank case 23 and is the lowest portion of the first chain tunnel 319. Accordingly, the first chain tunnel 319 communicates with the crank case 23 through the oil hole 341 (see FIG. 2). As shown in FIGS. 2 and 3, the oil hole 341 is formed in a position of the internal surface of the first skirt accommodating portion 351*b* in the crank chamber 351 which is opposed to the outer peripheral surface of the skirt portion 401*a* of the forward cylinder. With such a structure, the lubricating oil flowing into the crank chamber 351 through the oil hole 341 hits against the outer periphery of the skirt portion 401*a* of the forward cylinder. An arcuate lubricating oil guide rib 361 is formed on the internal surface of the side wall of the crank chamber 351 to extend forward and downward from the lower part of the rear edge portion 341*a* of the opening of the oil hole 341 along the trajectory 206 of the crank web by a predetermined length. The lubricating oil guide rib 361 is positioned to have a clearance with the trajectory 206 of the crank web as seen from a side and protrudes from the internal surface of the crank chamber 23 to a position which is close to the outer periphery of the skirt portion 401*a* of the forward cylinder 21 as seen in a longitudinal direction. Consequently, the lubricating oil guide rib 361 can downward guide the lubricating oil flowing into the crank chamber 351 through the oil hole 341, hitting against the outer periphery of the skirt portion 401*a* of the forward cylinder 21 and thus dropped so as not to spill the lubricating oil as much as possible without coming in contact with the turning crank web 53. Moreover, communicating portions 358*d* and 358*e* are formed between the internal surface of the front wall of the crank case 23 and the partition wall 358 configuring the crank chamber 351 and the oil chamber 353. Consequently, a lubricating oil flow-down path is formed from the oil hole 341 to the oil passage 41 of the oil chamber 353. Referring to the rearward cylinder, a lubricating oil flow-down path (a second lubricating oil feedback path) is formed to reach the oil chamber 353 from the second chain tunnel 320 through the chain chamber 360*a*, which is not shown. In the present embodiment, thus, a lubricating oil feedback path (a first lubricating oil feedback path) is formed to enter the crank chamber 351 through the first chain tunnel 319, so that the first chain tunnel 319 is formed to be terminated in a position including the intermediate shaft 301. Therefore, a section of the side wall of the crank chamber 351 which surrounds the crank shaft 24 can be utilized for other purposes. More specifically, in the present embodiment, the double row ball bearing (the first bearing) 25 is provided in the same section, the belt converter 31 is provided close to the crank chamber 351, and the ambient air intake passage 323 for cooling the belt converter 31 is formed in a space provided around the support boss 23*d* of the double row ball bearing 25. Consequently, the width of the V-twin engine 11 can be reduced.

Next, description will be given to a forcible lubricating operation for the cylinder head portion of the V-twin engine having the above-mentioned structure.

In FIGS. 1 to 6, when the V-twin engine 11 is started, the crank shaft 24 is rotated so that the oil pump 43 is driven to supply the lubricating oil in the oil sump 40 to the head portions 21*a* and 22*a* of the forward cylinder 21 and the rearward cylinder 22. The lubricating oil thus supplied lubricates the cam shafts 302 and 303, then passes through the first and second chain tunnels 319 and 320 and flows down into the oil sump 40 of the oil chamber 353. Consequently, the forcible lubricating operation for the cylinder head portion is carried out. In this case, the lubricating oil flowing down through the first chain tunnel 319 enters the crank chamber 351 through the oil hole 341, and hits against the outer periphery of the cylinder skirt portion 401*a* of the forward cylinder and is thus dropped at that time. Thus, it is possible to effectively prevent the lubricating oil flowing in through the oil hole 341 from splashing on the connecting rod 28, the crank pin 52 and the crank web 53 and its temperature from being raised. Most of the lubricating oil thus dropped is received by the lubricating oil guide rib 361 and is guided downward. Consequently, it is possible to prevent the dropped lubricating oil from splashing on the crank web 53 or the like and its temperature from being raised. As shown in an arrow 407, the lubricating oil guided downward flows down along the internal surface of the front wall of the crank case 23 through the communicating portions 358*d* and 358*e* in the middle and reaches the oil passage 41 (see FIG. 3).

The present invention is not restricted to the above described embodiment.

For example, the engine does not need to be always provided with the belt converter.

Moreover, the portion from the cylinder head portion to the crank case in the lubricating oil feedback path reaching the oil sump from the cylinder head portion may be constituted by a chain tunnel and-a dedicated oil path.

As the present invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. An over-head cam type V-type engine comprising:

a crank case having a crank chamber;

a crank shaft provided to penetrate through the crank chamber;

a first cylinder and a second cylinder provided in an upper portion of the crank chamber to be positioned on virtual lines extending like a V-shape upward from a center of the crank shaft as seen in an axial direction of the crank shaft, respectively;

a cam shaft provided in a head portion of each of the first and second cylinders;

an intermediate shaft provided above the crank shaft to penetrate through the crank chamber;

a first transmitting means for transmitting a rotation of the crank shaft to the intermediate shaft through a chain at one of end sides of the intermediate shaft;

a chain chamber formed adjacently to a side portion of the crank chamber and serving to accommodate the first transmitting means;

a second transmitting means for transmitting a rotation of the intermediate shaft to the cam shaft of one of the first and second cylinders through a chain at the other end side of the intermediate shaft;

a first chain tunnel for accommodating the second transmitting means;

a third transmitting means for transmitting the rotation of the intermediate shaft to the cam shaft of the other cylinder through a chain at one of the end sides of the intermediate shaft;

a second chain tunnel for accommodating the third transmitting means;

an oil sump formed in a lower portion of the crank case and serving to accumulate a lubricating oil therein;

a forcible oil supply means for supplying the lubricating oil from the oil sump to the head portion of each of the first and second cylinders such that each cam shaft is lubricated;

a first lubricating oil feedback path formed such that the lubricating oil supplied to the head portion of one of the first and second cylinders flows down into the oil sump through the first chain tunnel and the crank chamber; and a second lubricating oil feedback path formed such that the lubricating oil supplied to the head portion of the other cylinder flows down into the oil sump through the second chain tunnel and the chain chamber.

2. The over-head cam type V-type engine according to claim 1, wherein the cylinder has a skirt portion, the skirt portion being provided to be inserted into the crank chamber, and an inlet hole for the lubricating oil flowing from the first chain tunnel into the crank chamber is opened in a portion of an internal surface of the crank chamber which is opposed to a peripheral surface of the skirt portion of the cylinder.

3. The over-head cam type V-type engine according to claim 2, wherein a lubricating oil guide member is provided on the internal surface of the crank chamber to guide the lubricating oil flowing into the crank chamber from the first chain tunnel through the inlet hole for the lubricating oil toward the oil sump avoiding a rotation region of the crank shaft accommodated in the crank chamber.

4. The over-head cam type V-type engine according to claim 3, wherein the lubricating oil member extends between an inner side surface of the crank chamber and an outer surface of the skirt portion of the cylinder circumferentially outside of rotation region of crank shaft from lower end of the inlet hole.

5. The over-head cam type V-type engine according to claim 1, wherein the first chain tunnel is formed to extend from the head portion of one of the first and second cylinders and terminated in a portion of the crank case which includes the other end of the intermediate shaft, a belt converter for transmitting a power of the V-type engine to a transmission is provided adjacently to the crank chamber in a portion of the crank shaft which protrudes from the crank chamber toward the other end side of the intermediate shaft, and an ambient air intake passage for cooling the belt converter is formed adjacently to a terminating portion of the first chain tunnel.

6. The over-head cam type V-type engine according to claim 5, wherein the ambient air intake passage is provided under the first chain tunnel and around a support boss which has a bearing supporting the crank shaft therein and protrudes from a side wall of the crank chamber.

* * * * *